United States Patent [19]

Witter

[11] 4,249,944

[45] Feb. 10, 1981

[54] METHOD OF MAKING ELECTRICAL CONTACT MATERIAL

[75] Inventor: Gerald J. Witter, Waukegon, Ill.

[73] Assignee: Fansteel Inc., North Chicago, Ill.

[21] Appl. No.: 28,541

[22] Filed: Apr. 9, 1979

Related U.S. Application Data

[62] Division of Ser. No. 827,590, Aug. 25, 1977, Pat. No. 4,162,160.

[51] Int. Cl.[3] ..... B22F 1/00

[52] U.S. Cl. ..... 75/211; 75/0.5 R; 75/213

[58] Field of Search ..... 75/211, 213, 0.5 R

[56] References Cited

U.S. PATENT DOCUMENTS

| | | | |
|---|---|---|---|
| 3,175,903 | 3/1965 | Herron | 75/211 |
| 3,453,105 | 7/1969 | Flaks et al. | 75/213 |
| 3,473,915 | 10/1969 | Pierret | 75/213 |
| 3,832,156 | 8/1974 | Wilson et al. | 75/213 |
| 3,846,126 | 11/1974 | Foley | 75/213 |
| 3,859,087 | 1/1975 | Backstrom | 75/213 |

*Primary Examiner*—Brooks H. Hunt

*Attorney, Agent, or Firm*—Barnes, Kisselle, Raisch & Choate

[57] ABSTRACT

An electrical contact material which is particularly well suited for use in circuit breaker switches consisting essentially of silver in the amount of about 20% to 50% by weight, nickel in the amount of about 2% to 13% by weight, phosphorous in the amount of about 90 ppm to 1000 ppm, and the remainder tungsten. In one embodiment of the contact material forming method provided by the invention, starting particle sizes and liquid phase sintering parameters are selected to yield a relatively coarse grain size in the contact material microstructure with an optimum combination of resistance to oxidation, electrical erosion and distortion associated with high-current interruptions.

10 Claims, 12 Drawing Figures

METHOD OF MAKING ELECTRICAL CONTACT MATERIAL

REFERENCE TO A CO-PENDING APPLICATION

This is a division of co-pending U.S. Pat. application Ser. No. 827,590 filed on Aug. 25, 1977 now U.S. Pat. No. 4,162,160 and assigned to Fansteel Inc. of Chicago, Illinois, which is the assignee hereof.

The present invention relates to electrical contact materials and, more particularly, to contacts and materials which are specifically adapted for use as contacts in circuit breaker switches or the like, and to methods for making the same.

Although various electrical contact materials for use in switches and circuit breakers have heretofore been proposed in the art, such contact materials have generally proven unsatisfactory as applied to circuit breakers in the intermediate or five to thirty amp range which are intended to perform simultaneously as switches. It is a general object of the present invention to provide improved contact materials which are particularly well adapted for this application, and to provide methods or processes for making the same. More particularly, it is an object of the present invention to provide improved contact materials for switches, circuit breaker switches and the like which have enhanced endurance to severe short circuit arcing without excessive material erosion or contact welding, and which retain a low electrical surface resistance and have a low temperature rise after a multiplicity of switching operations.

Figure 10:
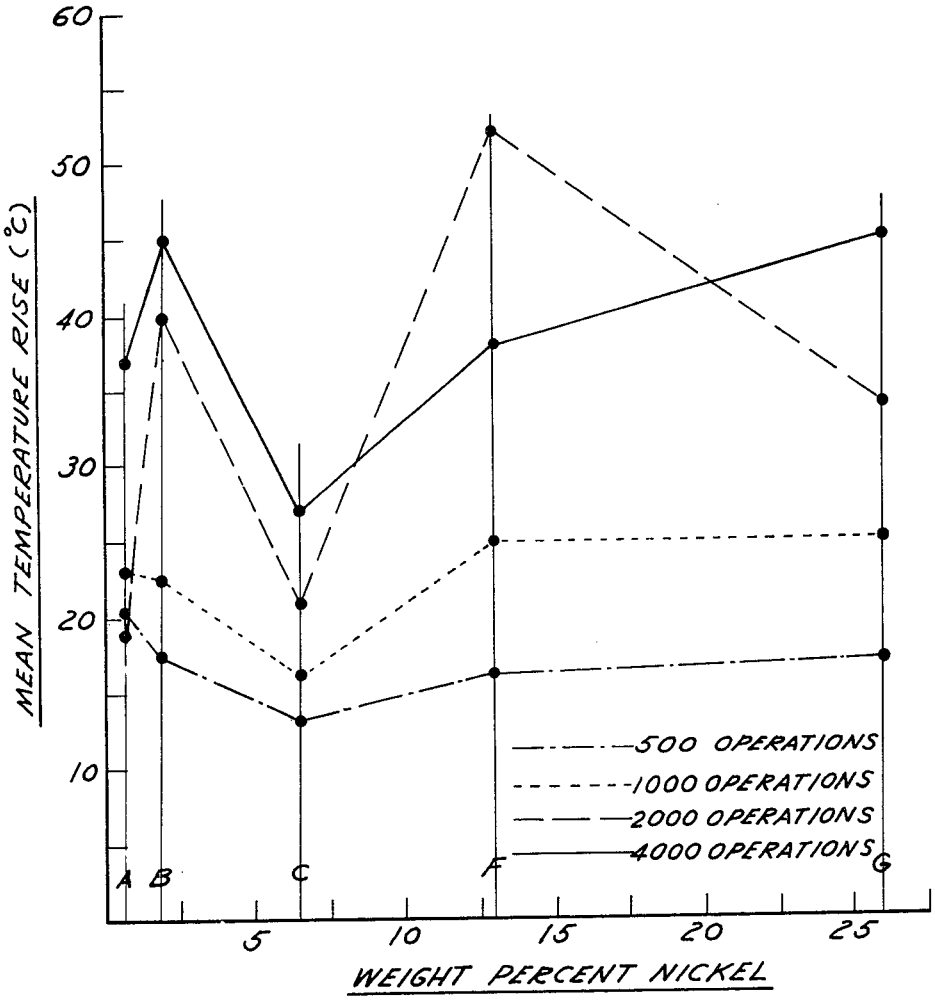
Figure 12:
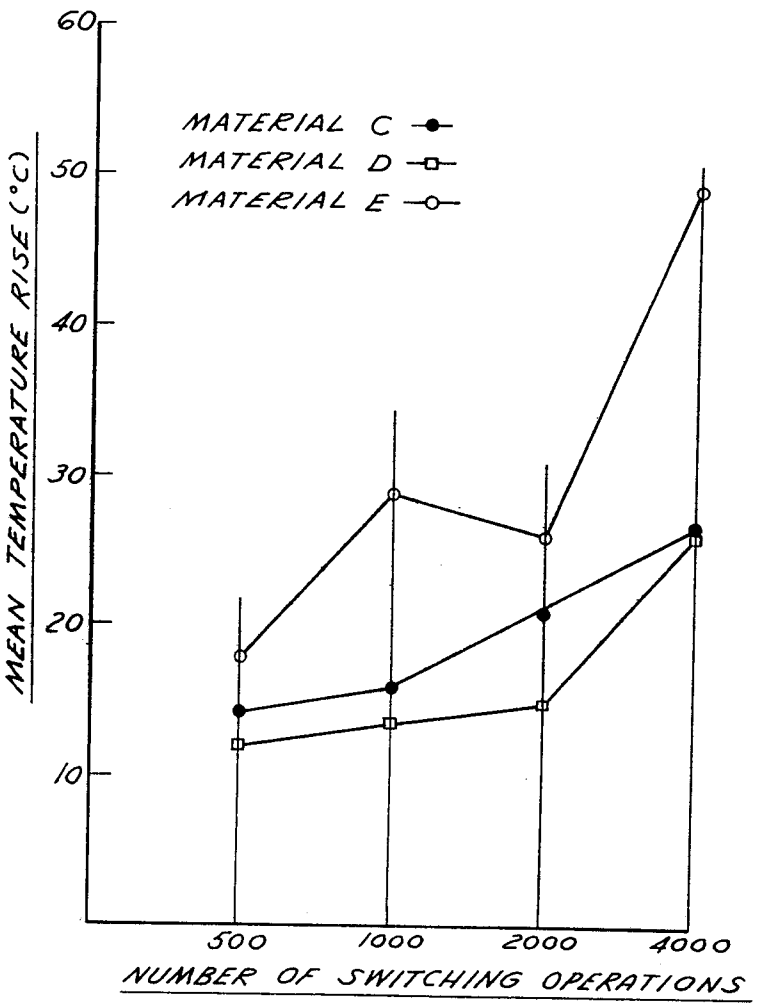
Figure 11:
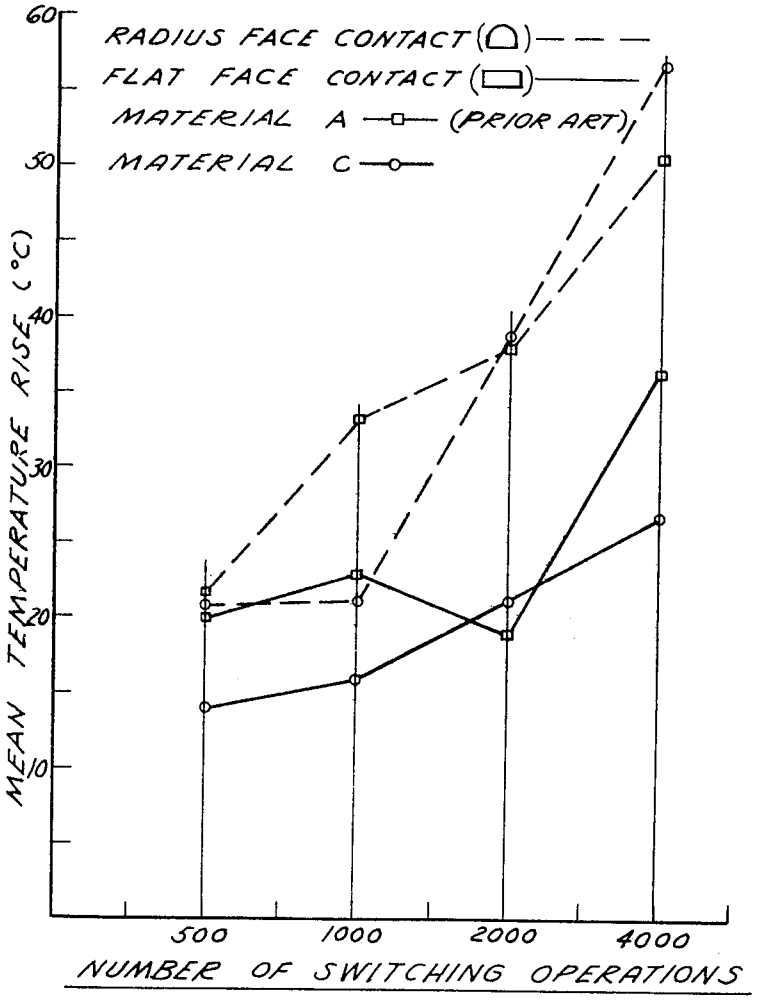

The invention, together with additional objects, features and advantages thereof, will be best understood from the following description when read in conjunction with the accompanying drawings in which:

FIGS. 1 to 9 are photomicrographs at 1000X of various materials discussed hereinafter; and FIGS. 10 to 12 are graphs illustrating operational advantages provided by the invention.

In the manufacture of silver/tungsten electrical contacts using liquid phase sintering techniques, three process stages have been recognized and may be generally described as follows: (1) flowing of the liquid phase into pores followed by rearrangement of solid particles to form a denser packing arrangement, (2) densification and grain growth through transport of the solid phase through the liquid phase, and (3) coalescence through solid state sintering. Since silver and tungsten show no solubility even in the silver/liquid state, the liquid phase sintering process for pure silver and tungsten powders involves only the first and third stage. It has heretofore been recognized that addition of small amounts of nickel (0.2% to 0.8% by weight) and phosphorus (up to about 300 ppm or 0.045% by weight) will provide better wetting between the silver and tungsten particles in the first stage, enhance grain growth and alloying of the tungsten particles in the second stage, and improve activation of solid state sintering in the third stage. Contacts, containing nickel and phosphorus in these amounts, silver in the range of 20% to 50% by weight and the balance (50% to 80% by weight) tungsten have been marketed by applicant's assignee. Prior investigations into the effects of providing higher nickel content—e.g., Kabayama et al, "Silver Tungsten Alloys with Improved Resistance," *Powder Metallurgy International,*

Vol. 5, No. 3, 1973—have concluded that the results were unsatisfactory for a variety of reasons.

In accordance with one aspect of the present invention, it has been discovered that a higher nickel content in the range of about 2% to 13%, preferably about 4% to 10% and, more particularly, about 6.5%, improves the temperature-rise characteristic of electrical contacts of the subject type while decreasing the tendency toward oxidation at the contact surface and still retaining satisfactory contact distortion and erosion characteristics. These advantages are particularly enhanced when phosphorus is added to the contact material in the range of about 90 ppm to 1000 ppm, preferably about 150 to 250 ppm and, more particularly, about 200 ppm.

Electrical contacts in accordance with the present invention include a conductive metallic constituent, preferably silver, palladium, platinum or mixtures thereof, and a refractory metallic constituent, preferably tungsten, molybdenum, their carbides or mixtures thereof. Palladium and platinum are relatively expensive and tungsten appears to yield better contact characteristics than does molybdenum. Hence, silver/tungsten and silver/tungsten-carbide are presently most preferred as the basic material compositions for conventional commercial applications. However, the discussion to follow with specific reference to silver/tungsten electrical contacts will be understood to be equally applicable to and encompass the above-noted materials and all other equivalents thereto.

Exemplary materials which have been tested to demonstrate the advantages of the present invention are set forth in Table 1 as follows:

TABLE 1

| | Powder Particle Size (Fisher Sub-sieve Size) | | | Composition by Weight | | | |
|---|---|---|---|---|---|---|---|
| Material Code | Ag μm | W μm | Ni μm | Ag % | W % | Ni % | P ppm |
| A | 1.3 | 1.2 | 2.5 | 35.0 | 64.4 | 0.6 | 241 |
| B | 1.3 | 1.1 | 2.5 | 35.0 | 63.0 | 2.0 | 236 |
| C | 1.1 | 1.1 | 2.5 | 35.0 | 58.5 | 6.5 | 219 |
| D | 4.9 | 5.5 | 2.5 | 35.0 | 58.5 | 6.5 | 219 |
| E | 1.1 | 1.1 | 2.5 | 35.0 | 58.5 | 6.5 | <10 |
| F | 1.1 | 1.1 | 2.5 | 35.0 | 52.0 | 13.0 | 195 |
| G | 1.1 | 1.1 | 2.5 | 35.0 | 39.0 | 26.0 | 146 |
| H | 1.1 | 1.1 | 2.5 | 50.0 | 45.0 | 5.0 | 169 |
| I | 4.9 | 1.1 | 2.5 | 20.0 | 72.0 | 8.0 | 270 |

The powder particle sizes were measured in accordance with ASTM B330-65, "Standard Method of Test for Average Particle Size of Refractor Metals and Compounds by the Fisher Sub-Sieve Sizes." Material A is exemplary of the above-noted prior art. These materials were all formed by a blend, press and liquid phase sinter process. The phosphorus, in the form of phosphoric acid, was added to the tungsten as a diluted aqueous solution and the liquid was evaporated to yield a tungsten powder with an approximate phosphorus content of 400 ppm. With the exception of material E which contained minimal phosphorus, the various material blends set forth in Table 1 thus vary in phosphorus content as a general function of tungsten content, within experimental tolerances.

The powder mixtures, with particle sizes shown in Table 1, were blended in a small Waring blender, water agglomerated after blending, baked in a hydrogen atmosphere to form aggregates and then deaggregated to form a −60 mesh powder. The deaggregated powders were then pressed into "green" compacts of an appropriate size and configuration for electrical contacts and sintered in a hydrogen atmosphere. Materials A-C and F-I were sintered at about 940° C. for one hour. Material D was sintered at 940° C. for about 40 hours. Batches of material E were sintered at about 940° C. for 14 hours and 960° C. for 5 hours. The sintered densities, conductivities and hardnesses for the various materials are shown in Table 2 as follows:

TABLE 2

| Material Code | Density g/cc | Percent Density % | Hardness $R_B$ | Conductivity % IACS |
|---|---|---|---|---|
| A | 14.6 | 98.4 | 87 | 54 |
| B | 14.4 | 98.2 | 88 | 52 |
| C | 14.0 | 99.3 | 91 | 45 |
| D | 13.8 | 98.0 | 78 | 48 |
| E | 4.0 | 99.3 | 90 | 41 |
| F | 13.3 | 99.6 | 92 | 37 |
| G | 11.9 | 98.4 | 87 | 26 |
| H | 13.0 | 99.5 | 68 | 58 |
| I | 15.2 | 99.3 | 101 | 34 |

The sintered microstructure of each of materials A–I is shown in FIGS. 1–9 respectively, wherein the silver is the white phase, the tungsten is the dark gray phase and the nickel is the lighter gray phase. The relationship between starting powder size, sintering parameters and material microstructures, and the effects thereof on contact operating characteristics will be discussed hereinafter.

The above materials were subjected to a plurality of switching and high current tests in both a test device and a conventional circuit breaker. In each case the switching load was 120VAC, 20 Amps, 60 Hz, 75% p.f. In the test device, the load current during temperature readings was 14 Amps, 120VAC and the switching duty cycle was 12.85 switching operations per minute, each operation comprising one closure followed by one opening of the contacts. The circuit breaker was operated at 12 operations per minute with a load of 20 Amps during reading. The structure of the circuit breaker in which the subject materials were tested is exemplified by Gelzheiser U.S. Pat. Nos. 3,088,008 and 3,110,786, the disclosures thereof being incorporated herein by reference. The test results may be summarized as follows:

The graphs of FIG. 10 illustrate mean temperature rise as a function of nickel content for materials A–C and F–G after 500, 1000, 2000 and 4000 switching operations. It will be noted from FIG. 10 that the materials exhibited significantly improved temperature rise performance over a plurality of switching cycles with an increased nickel content in the range of 2% to 13%, particularly in the range of 2% to 10% in materials B, C and F. The 6.5% nickel content of material C exhibits particularly marked improvement over prior art material A (0.6% nickel), as illustrated further in the graphs of FIG. 11 which show the mean temperature rise of materials A and C over a number of switching operations for both radiused and flat switch contact faces. The significantly superior performance of flat contact faces over radiused contact faces shown in FIG. 11 results from the fact that, in flat contacts, the "make and break" areas which are subject to arcing are much more separated from the normal current-carrying areas than is the case with radiused contacts. It is presently believed that nickel retards tungsten oxidation and the formation of $Ag_2WO_4$ on the contact surface to achieve this improved performance in temperature rise characteristics illustrated in FIGS. 10 and 11. The reason for the seemingly similar performance of material A to material C illustrated in both FIGS. 10 and 11 at 2000 switching operations but not at 500, 1000 or 4000 switching operations is unknown at this time.

Figure 1:
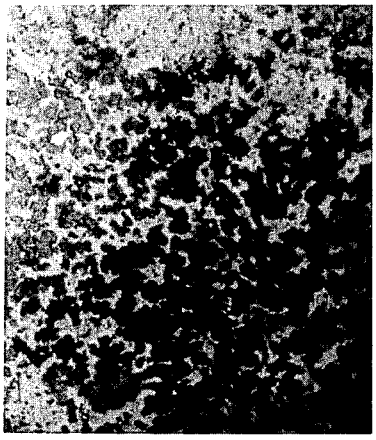
Figure 2:
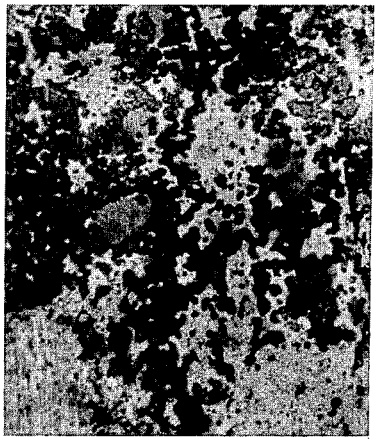
Figure 3:
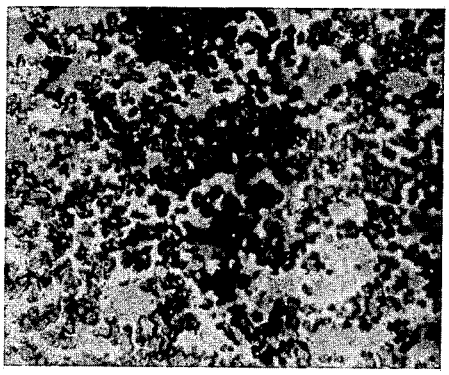
Figure 4:
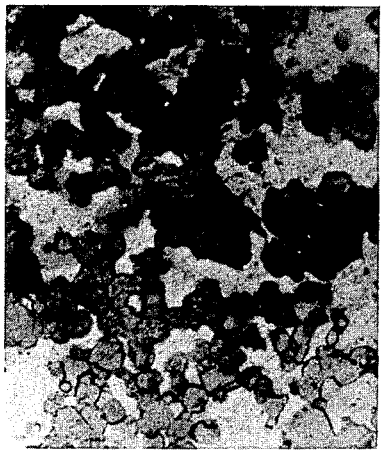
Figure 5:
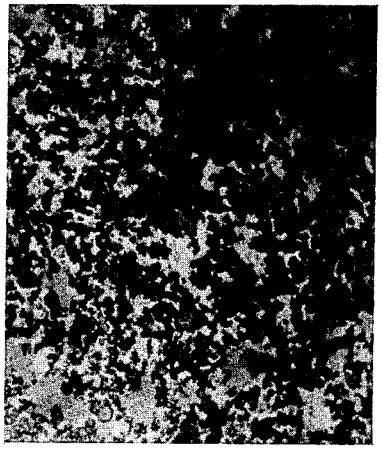
Figure 6:
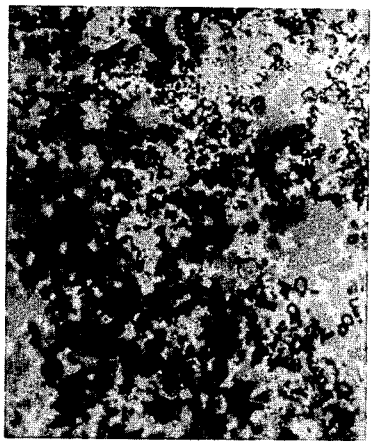
Figure 7:
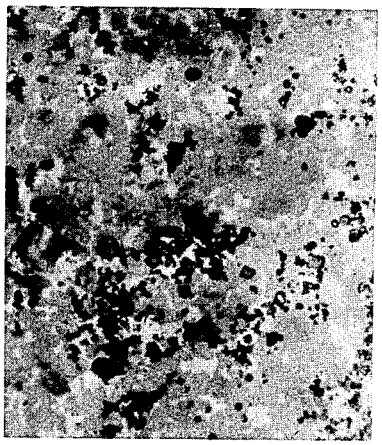
Figure 8:
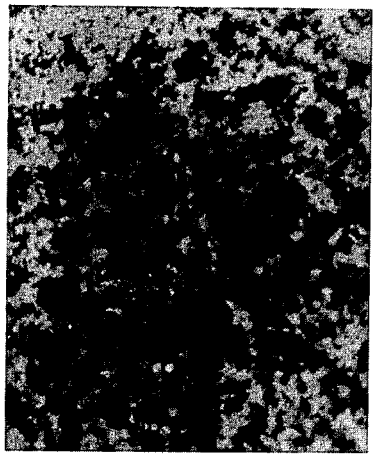
Figure 9:
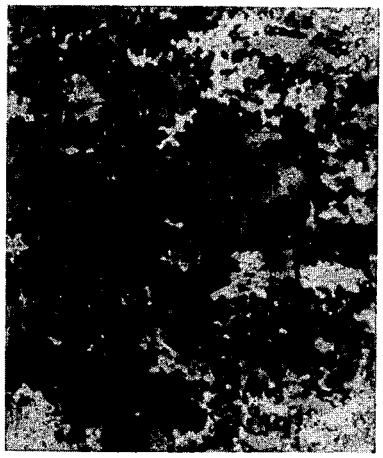

It was also found that material D, which had the same constituents as material C, performed significantly better than the latter material, as illustrated in FIG. 12 which shows the mean temperature rise for materials C, D and E after a number of switching operations. As best seen in FIG. 4, material D has a significantly coarser microstructure than do materials A (FIG. 1) and C (FIG. 3), for example, which results from both coarser starting materials (Table 1) and a longer sintering time. For such coarser materials, the silver is more free to segregate from the tungsten and thus to exist as free silver on the contact surface rather than as particles composed of fine tungsten and silver which could form the oxidized compound $Ag_2WO_4$. For a sintering temperature on the order of 940° C., a starting particular size range for the silver and tungsten powders of about 0.5 μm to 10 μm, preferably about 1 μm to 7 μm and, more particularly, about 5 μm (material D) is contemplated. Above 10 μm, sintering and consolidation will be very slow. As noted above, an increased sintering time, as on the order of 40 hours for example in material D, results in increased grain size and low temperature rise, and is preferred. The sintered tungsten particle sizes in materials C (FIG. 3), D (FIG. 4) and E (FIG. 5) have been measured as averaging about 1.3 μm, 3 μm and 0.9 μm, ±25% respectively using a metallographic measurement technique described by E. E. Underwood, *Quantitative Stereology,* Addison and Wesley, Reading, Mass., 1970.

The tendency of the contacts under test to erode and become distorted in use increased with increasing nickel content, whereas the tendency for formation of $Ag_2WO_4$ on the contact surface, with consequent increase in surface resistance, decreased with increasing nickel content as noted. An optimum trade-off between erosion and distortion on the one hand and temperature rise and surface resistance on the other hand is presently considered to be in the nickel content range of 2% to 13%, with the intermediate range of 4% to 10% and particularly about 6.5% being preferred.

It will also be appreciated with reference to FIG. 12 that material E, which has the same constituents as does material C but for the phosphorus content, and has the same sintering parameters, did not perform as well as did material C in terms of temperature rise. This is thought to result from the fact that, in the absence of phosphorus in material E, tungsten grain growth did not take place to a sufficient extent and more fine tungsten particles were retained in the sintered microstructure than was the case for material C where 219 ppm phosphorous was added. The phosphorus in material C, and particularly in material D, is believed to cooperate with the increased nickel content therein to promote tungsten grain growth in the second sintering stage, and to increase both the wetting between the tungsten and silver and the rate of tungsten bulk diffusion in the third sintering stage. A phosphorus content in the range of 90–1000 ppm will activate the sintering process to a sufficient extent to yield satisfactory results, with the range of about 150 to 250 ppm and, more particularly, about 200 ppm phosphorus content of materials C and D being preferred.

In material E, the two sintering batches, i.e., 940° C. for 14 hours and 900° C. for 5 hours, exhibited substantially identical characteristics, demonstrating to some extent the functional interchangeability of sintering time and temperature. It has also been discovered, somewhat surprisingly, that sintering time, sintering temperature and starting particle size all are important in determining the final grain structure and sintered particle size. This is somewhat contrary to the earlier understanding that sintering time had only a minimum effect on sintered particle size, and was demonstrated by the fact that compounds having widely varying particle sizes possessed similar microstructures after being sintered for several days. Of course, reduced sintering time is desirable from an economic standpoint. The test results for materials C and E indicate that a final particle size in the sintered material should be a minimum of at least about one micron to avoid a high temperature rise characteristic in the resulting contact.

In terms of silver content, materials having less than about 20% silver content (such as material I) were found to be too brittle and to have insufficient silver on the contact surface after sintering for spot welding or brazing, which are important requirements in the manufacture of contacts for circuit breakers. Materials having a silver content of more than about 50% (such as material H) exhibited a high temperature rise and erosion susceptibility over a number of switching operations. Thus, the invention envisions a silver content in the range of about 20% to 50% by weight, with a range of 30% to 40% silver by weight being preferred; a nickel content in the range of about 2% to 13% by weight, with an intermediate range of about 4% to 10% and particularly about 6.5% being preferred; a phosphorus content of about 90 to 1000 ppm with the intermediate range of about 150 to 250 ppm and particularly about 200 ppm being preferred; and the remainder (about 37% to 78% by weight) consisting essentially of tungsten.

I claim:

1. A method of making a powder for compacting and sintering comprising the steps of blending a powder mixture which includes a particulate electrically conductive metallic constituent in the amount of about 20% to 50% by weight, a particulate nickel constituent in the amount of about 2% to 13% by weight and the remainder a particulate refractory metallic constituent, each of said constituents having an average Fisher sub-sieve particle size not greater than about 10 μm, agglomerating said blended powder mixture with water, baking said agglomerated powder mixture to form aggregates thereof, and deaggregating said baked mixture to form a powder which will pass through a 60 mesh screen.

2. The method set forth in claim 1 comprising the further steps of doping a particulate refractory metallic constituent with a liquid solution containing phosphoric acid and evaporating said liquid to yield said particulate refractory metallic constituent with a phosphorus content in the range of about 90–1000 ppm of the total powder mixture.

3. The method set forth in claim 1 wherein said starting average particle sizes are in the range of about 1 μm to 7 μm.

4. The method set forth in claim 1 wherein said starting average particle sizes of said conductive metallic constituent and said refractory metallic constituent are about 5 μm.

5. The method set forth in claim 1 wherein said conductive metallic constituent is selected from the group consisting of silver, palladium, platinum and mixtures thereof, and said refractory metallic constituent is selected from the group consisting of tungsten, molybdenum, their carbides and mixtures thereof.

6. A method for making electrical contacts comprising the steps of blending a mixture which includes a particulate conductive metallic constituent in the amount of about 20% to 50% by weight, a particulate nickel constituent in the amount of about 2% to 13% by weight and the remainder a particulate refractory metallic constituent, each of said constituents having a Fisher subsieve average particle size of up to about 10 μm, agglomerating said blended mixture with water, baking said agglomerated mixture to form aggregates, deaggregating said baked mixture of aggregates to form a powder, compacting said powder into a desired size, and liquid phase sintering said compacted powder.

7. The method set forth in claim 6 comprising the further steps of doping said particulate refractory constituent with a liquid solution containing phosphoric acid and evaporating said liquid to yield said particulate refractory metallic constituent with a phosphorus content in the range of about 90–1000 ppm of the total mixture.

8. The method set forth in claim 6 wherein said starting average particle sizes are in the range of about 1 μm to 7 μm.

9. The method set forth in claim 6 wherein said starting average particle sizes are about 5 μm.

10. The method set forth in claim 6 wherein said conductive metallic constituent is selected from the group consisting of silver, palladium, platinum and mixtures thereof, and said refractory metallic constituent is selected from the group consisting of tungsten, molybdenum, their carbides and mixtures thereof.

* * * * *